US005709590A

United States Patent [19]

McPhee et al.

[11] Patent Number: 5,709,590

[45] Date of Patent: Jan. 20, 1998

[54] PRESSURE-BALANCED VACUUM BLAST HEAD

[75] Inventors: William S. McPhee, Arlington; Anh Nguyen, Herndon, both of Va.

[73] Assignee: LTC Americas Inc., Sterling, Va.

[21] Appl. No.: 543,143

[22] Filed: Oct. 13, 1995

[51] Int. Cl.[6] ..... B24C 5/04

[52] U.S. Cl. ..... 451/87; 451/102; 451/101

[58] Field of Search ..... 451/87, 88, 92, 451/102, 101, 90

[56] References Cited

U.S. PATENT DOCUMENTS 2,455,514 12/1948 Mead ..... 451/88

3,675,452 7/1972 Osmolovsky et al. ..... 451/102

4,993,200 2/1991 Morioka et al. ..... 451/90

FOREIGN PATENT DOCUMENTS 403544 10/1973 U.S.S.R. ..... 451/102

*Primary Examiner*—Robert A. Rose

*Attorney, Agent, or Firm*—Lane, Aitken & McCann

[57] ABSTRACT

In a blast head for a vacuum blasting operation, abrasive particles in a stream of compressed air are directed against a work surface and removed by vacuum. Ambient air is directed into the blast head upstream of the work surface to reduce frictional forces between the blast head and the work surface due to the vacuum. The ambient air is admitted through a one-way spring biased valve. The flow of ambient air into the blast head is controllable by adjusting the spring force in the valve.

8 Claims, 3 Drawing Sheets

PRESSURE-BALANCED VACUUM BLAST HEAD

BACKGROUND OF THE INVENTION

The present invention relates to vacuum blasting, and more particularly, to a blast head for the recovery of abrasives and debris for vacuum-blasting machines.

As will be appreciated by those skilled in the art, vacuum blasting refers to an improved technology for cleaning and preparing surfaces by blasting the surface with abrasive particles entrained in a relatively high velocity air stream and simultaneously vacuuming away abrasive particles and debris. In a vacuum blast head, a small hood surrounding the blasting nozzle and a vacuum port within the hood adjacent the nozzle suck up the abrasive particles and debris loosened from the surface being blasted. This abrasive particle and debris mixture passes through a hose to a separator, where the debris is separated from the abrasive particles. The separated debris is deposited in a closed waste chamber, which is maintained below atmospheric pressure during the blasting operation. Abrasive particles separated from the debris are returned to a hopper and used again in the blasting operation. Vacuum-blasting machines provide closed-system blasting by making the blast head in effect a small containment structure. Coating and/or corrosion materials removed from the surface being treated and spent abrasive particles are deposited in a closed waste chamber. In operation, the system is virtually dust free and, therefore, relatively safe for the operator and the environment, even when used to blast surfaces covered with potentially hazardous materials, such as lead and radioactive contaminants.

A problem associated with existing vacuum blast heads is the shear force or friction between the surface to be treated and a seal or brush on an adjacent, open end of the blast head, due to a net vacuum inside the blast head when the effects of the compressed air stream (blast pressure) and the vacuum source are added. With a large blast head, this frictional force due to the suction is strong enough to make it difficult to move the blast head on the surface being treated. For example, for a blast head having an opening 8 inches in diameter, a net vacuum in the blast head of 1 psi results in a suction force of about 50 pounds holding the blast head against the work surface.

One existing solution to the above problems is to adjust the vacuum and the blast pressure so that the pressure differential inside the blast head is minimal. This method works only when blast pressure and vacuum pressure do not fluctuate. It does not work at times when the blast pressure is off. A second existing solution is to use wheels or rollers mounted at the open end of the blast head to keep the blast head a constant distance from the surface to be cleaned. This approach works only on even surfaces that are flat or regular. On irregular surfaces, which most surfaces are to at least some extent, this configuration does not work properly. Furthermore, the wheels can scratch the surface.

SUMMARY OF THE INVENTION

By the present invention, a vacuum blast head is provided which can be moved along a work surface with only minimal hindrance from friction between the blast head and the work surface due to a vacuum in the blast head. The blast head can be moved without such hindrance in any operational condition of the blast head and without devices which might scratch or otherwise damage the work surface.

The above advantages are made possible by the controlled admission into the blast head of ambient air, thereby reducing vacuum forces drawing the blast head against the work surface. The ambient air is admitted to the interior of a blast jacket upstream of an open end of the blast head with respect to the flow of abrasive particles in a stream of compressed air. Conducting the ambient air to a point upstream rather than downstream of the open end of the blast head has minimal effect on the efficiency of the removal of abrasive particles and debris by the vacuum. The air is admitted through a one-way spring biased valve mounted in a pressure-balancing port connecting the interior of the blast head with the surrounding atmosphere. The biasing force is adjustable to permit the inflow of ambient air to be changed in accordance with the prevailing conditions. The adjusting mechanism is manipulatable by hand so that the inflow of ambient air can be adjusted as needed by the blast head operator.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF THE PREFERRED EMBODIMENTS

Figure 1:
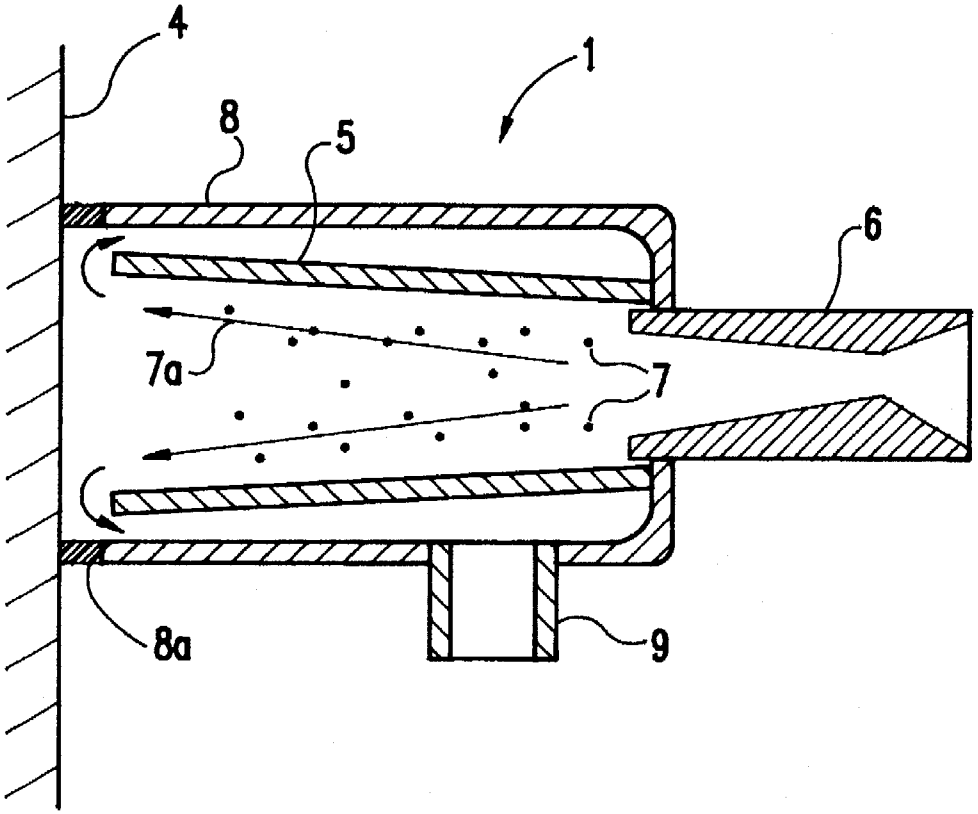
FIG. 1 PRIOR ART
FIG. 1 is a schematic axial cross section through a known vacuum blast head.

As can be seen from FIG. 1, a prior art blast head, indicated generally by the reference numeral 1, is being used to clean a planar surface 4. The planar surface is typically a member of a bridge, building, ship or the like. The blast head 1 includes a blast jacket 5, a nozzle 6 feeding abrasive particles 7 in a stream of compressed air through the blast jacket for engagement with the surface to be cleaned, a vacuum jacket 8 surrounding the blast jacket, and a takeoff 9 in the vacuum jacket, connected to a vacuum source, for recovering the abrasive particles and debris removed from the work surface. The general trajectory of the particles 7 is indicated by the arrows 7*a*. A seal 8*a* of rubber or other material is secured at a forward end of the vacuum jacket 8 for engaging a work surface and preventing the escape of abrasive particles 7. The magnitude of the vacuum is greater than the magnitude of the pressure of the compressed air at the forward end of the blast head 1. As a result, there is a resultant vacuum which draws the blast head 1 into forceful engagement with the work surface 4 and makes movement of the blast head on the work surface difficult.

Figure 2:
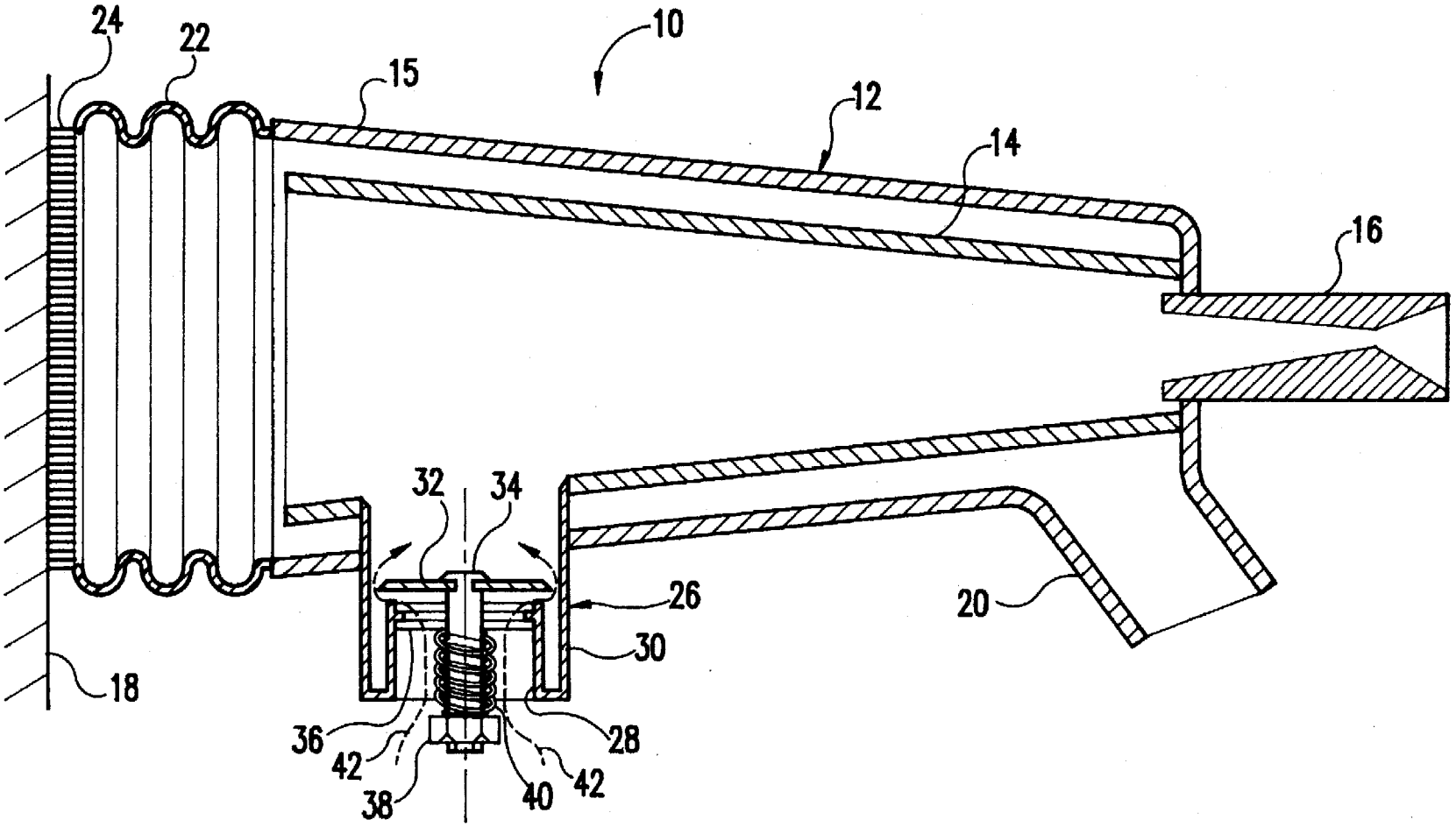
FIG. 2 is an axial cross section through a blast head according to the present invention.

As can be seen from FIG. 2, a blast head according to the present invention, which is designated generally by the reference numeral 10, defines a blast head body 12 comprising a blast jacket 14 and a vacuum jacket 15 surrounding the blast jacket. A nozzle 16 secured in a closed end of the blast head body 12 feeds abrasive particles in a stream of compressed air through the blast jacket 14 to impinge upon a surface 18 to be cleaned. A takeoff port 20 is defined by the vacuum jacket 15 adjacent the closed end of the blast head body 12 and is connected to a vacuum source for recovering the abrasive particles and debris removed from the work surface 18. A flexible bellows 22 of, for example, elastomeric material, is secured at an open end of the vacuum jacket 15, adjacent to the work surface 18 in order to maintain a vacuum seal on curved surfaces as well as on planar surfaces. Brush bristles 24 can be provided around the circumference of the bellows 22 at an end of the bellows adjacent to the work surface 18 in order to provide conformity to small irregularities of the surface and to ease the sliding of the blast head 10 on the work surface. The blast jacket 14 has an open end which terminates short of the open end of the vacuum jacket 15 in the axial direction so that an adequate flow path for the particles from the blast jacket 14 to the work surface 18 and back between the blast jacket 14 and the vacuum jacket 15 is preserved even when the bellows 22 is completely compressed.

Despite the entry into the blast body 12 of particles in a stream of compressed air, the vacuum source maintains an overall condition of vacuum in the blast body. For a vacuum of just 1 psi in a blast head 10 having an 8 inch diameter opening at the work surface, 50 pounds of force hold the blast head 10 against the work surface. In order to reduce the force to a manageable size, the present invention provides a flow of ambient air into the blast head body 12 in an adjustable, controlled manner. The ambient air is conducted into the interior of the blast jacket 14 by a pressure balancing port 26 which is mounted in an opening in the blast jacket 14. The pressure balancing port 26 also extends through an opening in the vacuum jacket 15 and projects beyond the vacuum jacket to define a valve body for a spring-biased one-way pressure balancing valve. The pressure balancing port 26 includes an inner cylinder 28, which may be made in one piece with an outer cylinder 30. The outer cylinder 30 fits tightly within an opening in the vacuum jacket 15 to prevent any uncontrolled flow of ambient air into the space between the vacuum jacket 15 and the blast jacket 14. A valve seat is defined at an upper end of the inner cylinder 28 to engage a valve element 32 mounted at an upper end of a bolt 34. The bolt is guided for movement in an opening in a hub of a spider 36 which is secured in the inner cylinder 28. A nut 38 engages the threads of the bolt 34, and a coil compression spring 40 is positioned around the bolt between the nut and the spider 36. By this arrangement, the spring 40 biases the valve element 32 into engagement with the valve seat. The difference in pressure between the ambient air and the vacuum inside the blast head body 14 moves the valve element 32 away from the valve seat and compresses the spring 40. As a result, ambient air flows into the blast head body 12 through the pressure balancing port 26 as indicated generally by the arrows 42.

The vacuum force holding the blast head body 12 against the work surface 18 can be adjusted by turning the nut 38. Turning the nut 38 moves the nut axially along the bolt 34 and compresses or elongates the compression spring 40, thereby increasing or decreasing the biasing force tending to move the valve element 32 against the valve seat. An increased biasing force reduces the amount of ambient air flowing into the blast head body 12, and a decreased biasing force increases the amount of ambient air flowing in. Positioning of the pressure balancing valve on the blast head body 12 places the valve in a convenient location for hand manipulation by the blast head body operator while holding and moving the blast head body 12.

Figure 3:
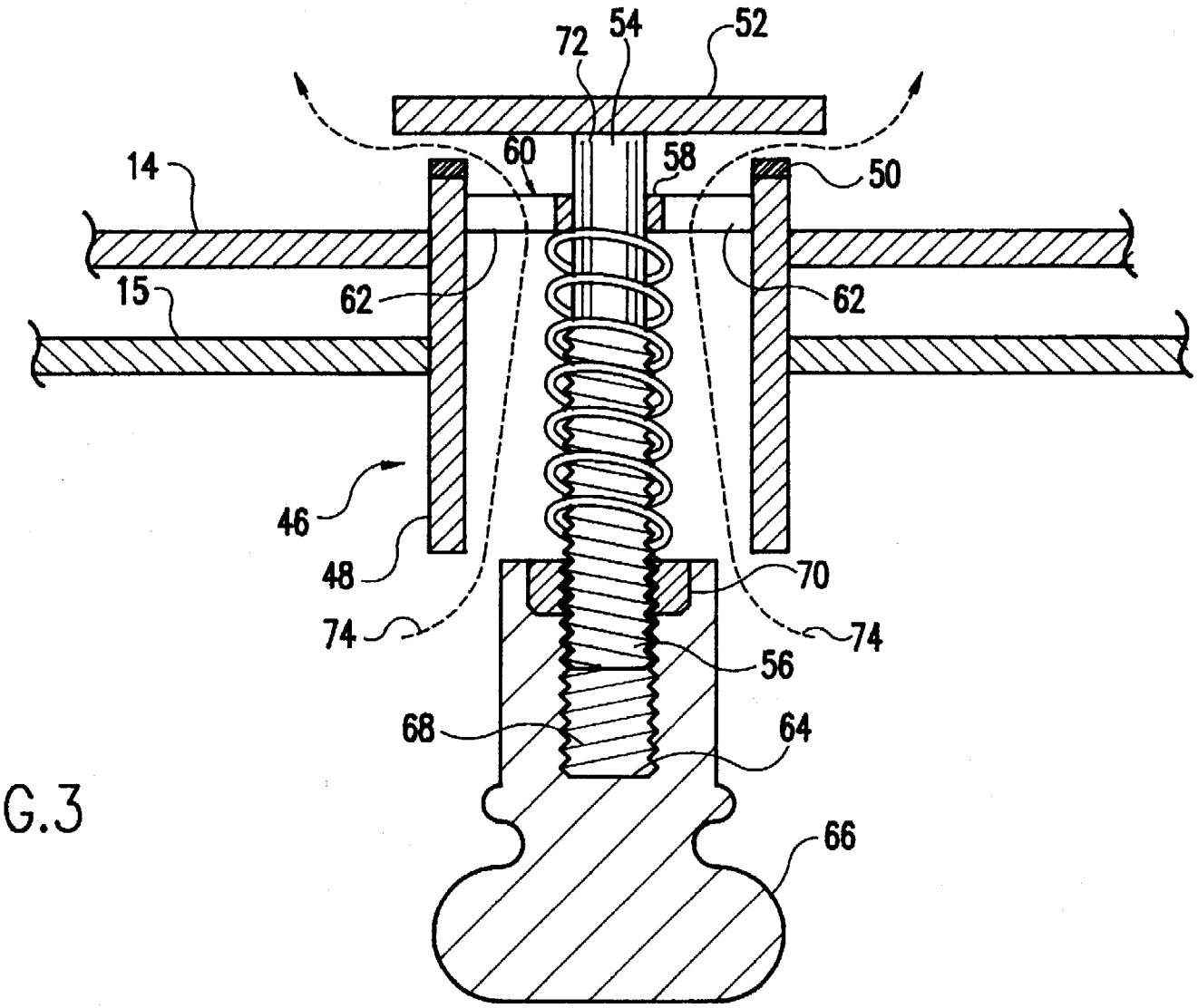
FIG. 3 is an enlarged cross section of a fragment of a blast head according to the present invention showing an alternate form of pressure balancing valve.

FIG. 3 shows an enlarged alternate embodiment of pressure balancing valve. A pressure balancing valve 46 has a cylindrical valve body 48 which defines the pressure balancing port. The valve body 48 is secured in an opening in the blast jacket 14 and extends outward through an opening in the vacuum jacket 15, in which the valve body 48 is tightly received to avoid leakage. The cylindrical body 48 projects inward of the blast jacket 14 and terminates in an inner end on which an elastomeric sealing ring 50 is secured to define a valve seat. A valve element 52, which is arranged for engagement with the sealing ring 50, is secured at an upper end of a shaft 54 having threads 56. The shaft 54 is guided for axial movement in a hub 58 of a spider 60, the spider also having radially extending legs 62 and being secured in the valve body 48 in a conventional manner. A lower end of the shaft 54 carrying the threads 56 is received in a bore 64 of a knob 66. Threads 68 may be provided in the bore for engaging the threads 56. As an alternative, the threads associated with the knob 66 may be provided in a nut 70 held within the knob 66, or threads may be present in both the nut 70 and the bore 64. A compression spring 72 is positioned around the shaft 54 and held in compression between an upper end of the knob 66 and the spider 60. A suitable mechanism may be provided to prevent the shaft 54 from rotating when the knob 66 is turned. For example, ribs 72 can be provided on the shaft 54 to cooperate with grooves in the hub 58 of the spider 60. The knob 66 is turned to adjust the flow of ambient air into the blast head body 12 in the same manner that the nut 38 of the embodiment of FIG. 2 is turned. In FIG. 3, the inflow of ambient air through the valve body 48 and between the legs 62 of the spider 60 is represented by the arrows 74.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A blast head for a vacuum-blasting machine, comprising:

a body having an interior and an open end;

means for sending abrasive particles under pressure through said body toward said open end;

means for maintaining the interior of said body under a vacuum; and means for limiting the vacuum in said body, said limiting means comprising means for conducting ambient air into said body, wherein said conducting means comprises a valve having an inlet and an outlet, said valve being openable by a first difference in pressure from said inlet to said outlet.

2. The blast head of claim 1, further comprising means for adjusting said valve to be openable by differences in pressure from said inlet to said outlet other than said first difference.

3. The blast head of claim 1, wherein said adjusting means comprises a hand-manipulatable device.

4. A blast head for a vacuum-blasting machine, comprising:

a body having an interior and an open end;

means for sending abrasive particles under pressure through said body toward said open end;

means for maintaining the interior of said body under a vacuum; and means for limiting the vacuum in said body, said limiting means comprising means for conducting ambient air into said body, wherein said body comprises a blast jacket and a vacuum jacket surrounding said blast jacket, said means for sending comprises means for sending the abrasive particles through said blast jacket to said open end of said body, and said means for maintaining a vacuum comprises a vacuum port defined in said vacuum jacket, wherein a first flow path for conveying the abrasive particles to said open end is defined by said blast jacket, and a second flow path for conveying the abrasive particles away from said open end is defined between said blast jacket and said vacuum jackets, and wherein said means for conducting ambient air into said body comprises means for conducting ambient air into said blast jacket.

5. The blast head of claim 4, wherein said conducting means comprises a valve having an inlet and an outlet, said valve being openable by a first difference in pressure from said inlet to said outlet.

6. The blast head of claim 5, further comprising means for adjusting the valve to be openable by differences in pressure from said inlet to said outlet other than said first difference.

7. The blast head of claim 6, wherein said adjusting means comprises a hand-manipulatable device.

8. A method for facilitating the movement on a work surface of a blast head for a vacuum blasting machine, wherein abrasive particles in a pressure fluid stream are directed against the work surface and drawn away from the work surface by a vacuum and the blast head is drawn against the work surface by the vacuum, comprising:

limiting the vacuum in the blast head by conducting ambient air into the blast head, wherein the ambient air is conducted into the blast head through a valve that opens in response to a first difference between ambient air pressure and the pressure inside the blast head.

* * * * *